US011242867B2

(12) United States Patent
Hsu

(10) Patent No.: US 11,242,867 B2
(45) Date of Patent: Feb. 8, 2022

(54) FAN STRUCTURE

(71) Applicants: Inventec (Pudong) Technology Corporation, Shanghai (CN); INVENTEC CORPORATION, Taipei (TW)

(72) Inventor: Yung-Chin Hsu, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 191 days.

(21) Appl. No.: 16/714,782

(22) Filed: Dec. 15, 2019

(65) Prior Publication Data

US 2021/0148382 A1 May 20, 2021

(30) Foreign Application Priority Data

Nov. 19, 2019 (CN) ..... 201911136350.X

(51) Int. Cl.

| | |
|---|---|
| ***F04D 29/64*** | (2006.01) |
| ***F04D 19/00*** | (2006.01) |
| ***F04D 29/40*** | (2006.01) |
| ***F04D 25/16*** | (2006.01) |

(52) U.S. Cl.

CPC ..... *F04D 29/646* (2013.01); *F04D 19/002* (2013.01); *F04D 25/166* (2013.01); *F04D 29/40* (2013.01)

(58) Field of Classification Search

CPC ..... F04D 19/002; F04D 25/08; F04D 25/12; F04D 25/166; F04D 29/40; F04D 29/522; F04D 29/646

USPC ..... 415/213.1

See application file for complete search history.

(56) References Cited

U.S. PATENT DOCUMENTS

| | | | | |
|---|---|---|---|---|
| 4,834,615 A * | 5/1989 | Mauch | F24F 13/32 | 415/213.1 |
| 5,906,475 A * | 5/1999 | Melane | F04D 29/601 | 415/214.1 |
| 6,556,437 B1 * | 4/2003 | Hardin | H05K 7/20172 | 361/679.48 |
| 6,587,342 B1 * | 7/2003 | Hsu | G06F 1/20 | 165/80.3 |
| 6,592,327 B2 * | 7/2003 | Chen | F04D 25/166 | 415/213.1 |

(Continued)

*Primary Examiner* — Alexander B Comley

(74) *Attorney, Agent, or Firm* — CKC & Partners Co., LLC

(57) ABSTRACT

A fan structure includes a fan frame and a fan body. The fan frame includes two side plates, a first connecting plate, a buckling portion and a second connecting plate. The side plate includes a fan stopping plate, a first protruding portion and two second protruding portions. The first protruding portion and the second protruding portions are disposed on the fan stopping plate. The first connecting plate is connected with the fan stopping plates. The buckling portion is disposed on the first connecting plate. The second connecting plate connects with the fan stopping plates and the first connecting plate. The fan body is accommodated between the side plates. The fan body has some first and second recessed portions which accommodate the first protruding portions and the second protruding portions respectively. The side plates, the first connecting plate and the second connecting plate are integrally formed.

8 Claims, 4 Drawing Sheets

(56) References Cited

U.S. PATENT DOCUMENTS 6,826,048 B1 * 11/2004 Dean ..... F04D 29/601 165/122
7,172,390 B2 * 2/2007 Lu ..... H05K 7/20172 415/213.1
7,301,768 B2 * 11/2007 Fan ..... H05K 7/20172 16/422
7,522,415 B2 * 4/2009 Fan ..... F04D 29/601 312/236
7,641,443 B2 * 1/2010 Chuang ..... F04D 29/526 415/213.1
8,177,504 B2 * 5/2012 Zhang ..... F04D 25/0613 415/213.1
8,322,974 B2 * 12/2012 Chen ..... F04D 29/601 415/119
8,379,387 B2 * 2/2013 Chuang ..... H05K 7/20172 361/695
8,535,003 B2 * 9/2013 Wang ..... F04D 29/601 415/213.1
8,632,305 B2 * 1/2014 Zhang ..... F04D 25/0613 415/213.1
8,740,559 B2 * 6/2014 Wu ..... F04D 29/601 415/213.1
9,011,093 B2 * 4/2015 Mao ..... G06F 1/183 415/213.1
9,247,673 B2 * 1/2016 Kelaher ..... H05K 7/20145
9,913,401 B2 * 3/2018 Gonzalez Inda ..... F04D 29/522
9,938,987 B2 * 4/2018 Huang ..... F04D 25/0613
10,470,336 B2 * 11/2019 Chen ..... H05K 7/20172
10,485,136 B2 * 11/2019 Gopalakrishna ... H05K 7/20172
2007/0053159 A1 * 3/2007 Crippen ..... H05K 7/20172 361/695
2008/0253886 A1 * 10/2008 Chen ..... F04D 29/601 415/213.1
2013/0108436 A1 * 5/2013 He ..... F04D 29/60 415/213.1
2014/0079545 A1 * 3/2014 Ba ..... F04D 29/646 415/214.1
2018/0119701 A1 * 5/2018 Yu ..... F04D 29/601
2019/0182982 A1 * 6/2019 Gopalakrishna ..... G06F 1/181

* cited by examiner

FAN STRUCTURE

RELATED APPLICATIONS

This application claims priority to Chinese Application Serial Number 201911136350.X filed Nov. 19, 2019, which is herein incorporated by reference.

BACKGROUND

Technical Field

The present disclosure relates to fan structures. More particularly, the present disclosure relates to fan structures installed in electric equipment.

Description of Related Art

With the advancement of science and technology today, the demand of people for electronic equipment has been increasing. With regard to the design of electronic equipment, apart from the continuous enhancement of functions and operating efficiency, the durability is also an important point that the consumers concern about.

Therefore, in addition to pay full effort by the manufacturers to extend the working lives of each of the components inside the electronic equipment, how to replace those components inside the electronic equipment in a simple and quick manner is also undoubtedly an important direction of development for the industry.

SUMMARY

A technical aspect of the present disclosure is to provide a fan structure which can allow the user to install the fan body to the fan frame to form the fan structure in a simple and quick manner. The fan structure can also allow the user to install the fan structure to electric equipment or to take the fan structure away from the electric equipment in a simple and quick manner.

According to an embodiment of the present disclosure, a fan structure includes a fan frame and a fan body. The fan frame includes two side plates, a first connecting plate, at least one buckling portion, a power source and signal connecting portion and a second connecting plate. The side plates are opposite to each other. Each of the side plates includes a fan stopping plate, a first protruding portion and two second protruding portions. The first protruding portion is disposed on the fan stopping plate. The second protruding portions are elastically disposed on the fan stopping plate. The first connecting plate is connected with the fan stopping plates. The buckling portion is disposed on the first connecting plate and configured to buckle with electric equipment. The power source and signal connecting portion is disposed on the first connecting plate and configured to connect with a power source and signal device. The second connecting plate is connected with the fan stopping plates and the first connecting plate. The fan body is suitable to be accommodated between the side plates. The fan body has a plurality of first recessed portions and a plurality of second recessed portions. The first recessed portions are configured to accommodate the first protruding portions. The second recessed portions are configured to accommodate the second protruding portions. The side plates, the first connecting plate and the second connecting plate are of an integrally-formed structure.

In one or more embodiments of the present disclosure, the first connecting plate has a plurality of first hollow portions. Each of the fan stopping plates has a plurality of second hollow portions. Each of the first hollow portions and the corresponding second hollow portion communicate with each other. The fan frame further includes a plurality of first elastic structures. Each of the first elastic structures includes a first connecting portion and a second connecting portion connecting with each other. Each of the first connecting portions connects with the first connecting plate and is located at one of the first hollow portions. The corresponding second connecting portion is located at the corresponding second hollow portion. Each of the second protruding portions is disposed on the corresponding second connecting portion.

In one or more embodiments of the present disclosure, the first connecting portion and the second connecting portion connect to form a "L" shape.

In one or more embodiments of the present disclosure, each of the fan stopping plates has a plurality of third hollow portions. Each of the third hollow portions extends along a circular locus to form a fan shape. The third hollow portions are evenly disposed around a center of the circular locus.

In one or more embodiments of the present disclosure, the fan body has an entrance and an exit opposite to each other. The entrance and the exit respectively face to the fan stopping plates.

In one or more embodiments of the present disclosure, the second connecting plate has a third recessed portion and a fourth recessed portion opposite to each other. The first connecting plate has a fifth recessed portion. The fifth recessed portion and the fourth recessed portion communicate with each other. The fan frame further includes a second elastic structure. The second elastic structure is connected with the first connecting plate and at least partially located at the fifth recessed portion. The buckling portion is disposed on a side of the second elastic structure away from the third recessed portion.

In one or more embodiments of the present disclosure, the buckling portion is a hook structure.

In one or more embodiments of the present disclosure, the fan stopping plates are substantially parallel with each other. The first connecting plate and the second connecting plate are substantially perpendicular to the fan stopping plates respectively.

In one or more embodiments of the present disclosure, the first connecting plate and the second connecting plate are substantially perpendicular with other.

When compared with the prior art, the above-mentioned embodiments of the present disclosure have at least the following advantages:

(1) In the process to install the fan body into the fan frame, the fan body compresses on the second protruding portions such that the first elastic structures elastically deform. After the positions of the second recessed portions of the fan body match with the second protruding portions, the first elastic structures elastically recover such that the second protruding portions are accommodated in the second recessed portions. At this point, the positions of the first recessed portions of the fan body also match with the first protruding portions of the side plates, and the first protruding portions are also accommodated in the first recessed portions. In this way, the process to install the fan body to the fan frame is simple and quick without the usage of any extra component or tool. Thus, it is convenient to the user.

(2) When the user wants to install the fan structure into the electric equipment or to take the fan structure away from the electric equipment, the user can put, for example, the index finger at the position of the first recessed portion, and then press on the second connecting plate as a point of force exertion. The user can also press on the second elastic structure of the fan frame by the thumb, such that the second elastic structure deforms elastically towards the third recessed portion of the second connecting plate. Under this condition, the user can take the fan structure away from the electric equipment, or release the fingers to allow the second elastic structure to elastically recover, such that the buckling portion buckles with the through hole of the electric equipment, in order to complete the installation of the fan structure to the electric equipment. Since the process to install the fan structure to the electric equipment or to take the fan structure away from the electric equipment is simple and quick without the usage of any extra component or tool, it is convenient to the user.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
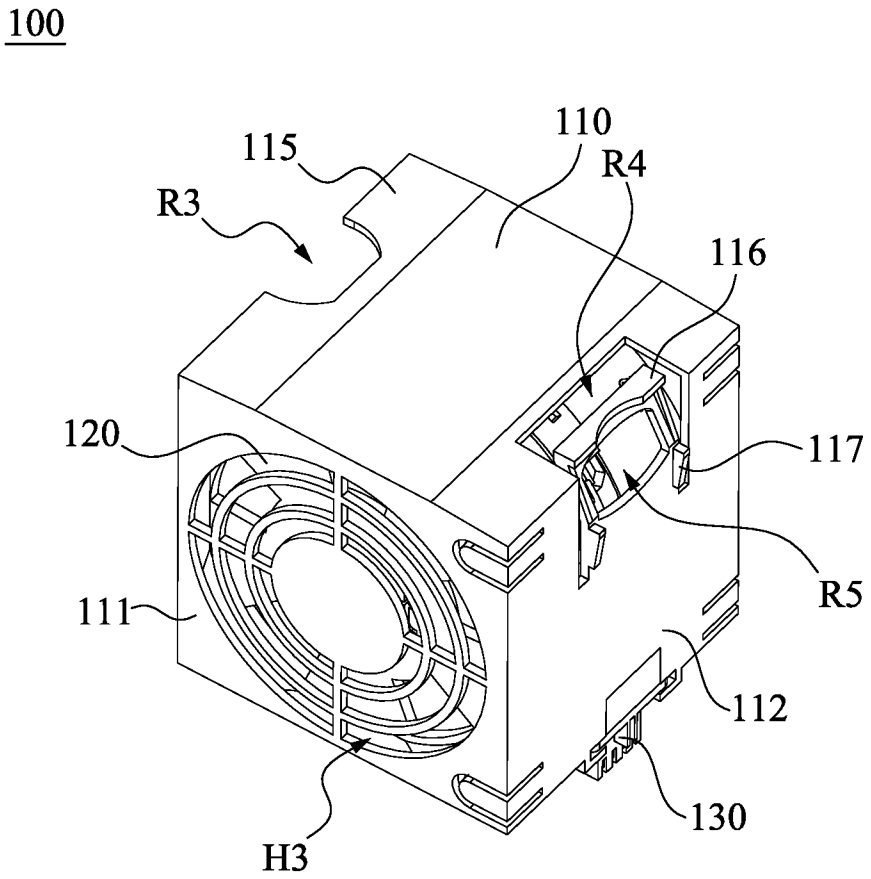
FIG. 1 is a schematic view of a fan structure according to an embodiment of the present disclosure.

Drawings will be used below to disclose embodiments of the present disclosure. For the sake of clear illustration, many practical details will be explained together in the description below. However, it is appreciated that the practical details should not be used to limit the claimed scope. In other words, in some embodiments of the present disclosure, the practical details are not essential. Moreover, for the sake of drawing simplification, some customary structures and elements in the drawings will be schematically shown in a simplified way. Wherever possible, the same reference numbers are used in the drawings and the description to refer to the same or like parts.

Unless otherwise defined, all terms (including technical and scientific terms) used herein have the same meanings as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 2:
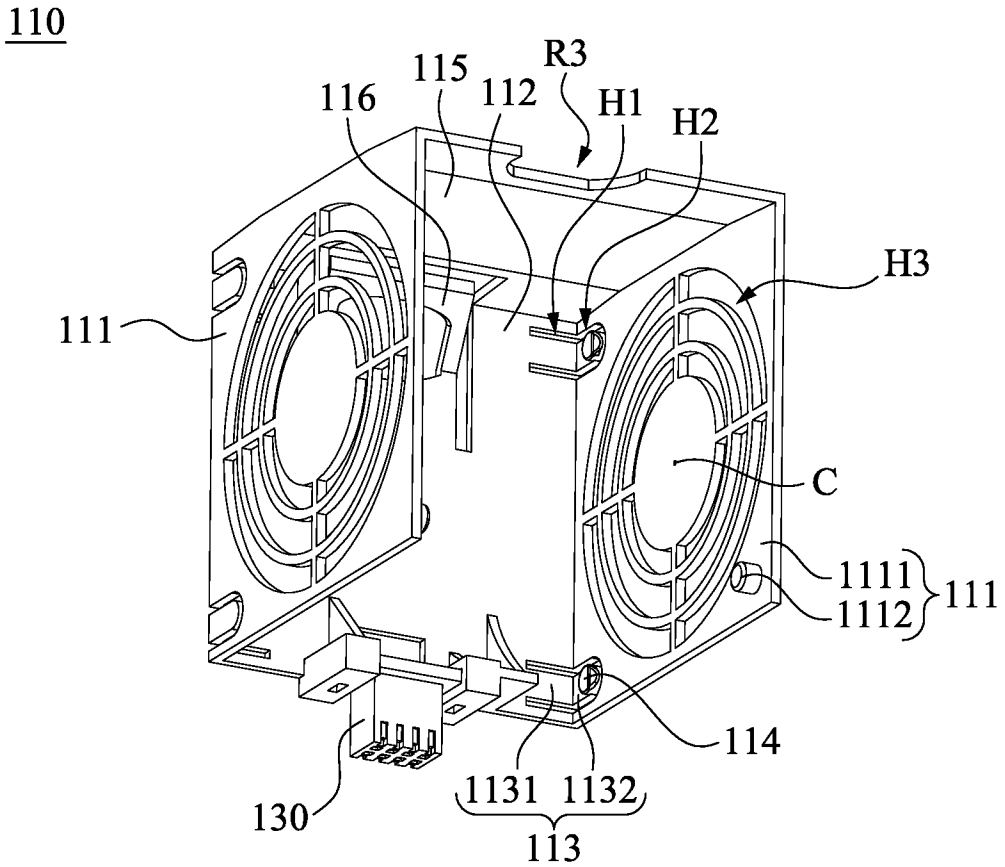
FIG. 2 is a schematic view of the fan frame of FIG. 1.
Figure 3:
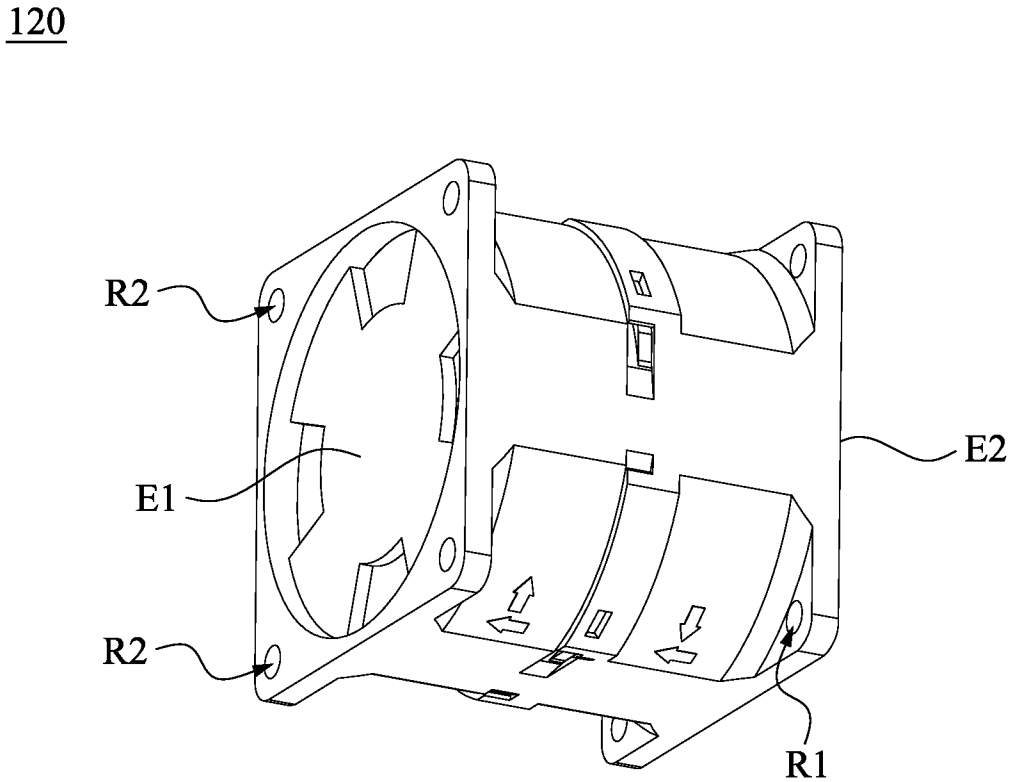
FIG. 3 is a schematic view of the fan body of FIG. 1.

Reference is made to FIGS. 1-3. FIG. 1 is a schematic view of a fan structure 100 according to an embodiment of the present disclosure. FIG. 2 is a schematic view of the fan frame 110 of FIG. 1. FIG. 3 is a schematic view of the fan body 120 of FIG. 1. In this embodiment, as shown in FIGS. 1-3, a fan structure 100 includes a fan frame 110 and a fan body 120. The fan frame 110 includes two side plates 111 opposite to each other. The side plates 111 are substantially symmetric to each other. Each of the side plates 111 includes a fan stopping plate 1111 and a first protruding portion 1112. The first protruding portion 1112 is disposed on the fan stopping plate 1111. The fan body 120 is suitable to be accommodated between the side plates 111. The fan body 120 has a plurality of first recessed portions R1. The first recessed portions R1 are configured to accommodate the first protruding portions 1112 of the side plates 111. When the fan body 120 is accommodated between the side plates 111 as shown in FIG. 1, the first protruding portions 1112 of the side plates 111 are accommodated in the first recessed portions R1 of the fan body 120, such that the fan body 120 can be fixed inside the fan frame 110. In practical applications, each of the first recessed portions R1 is a through hole.

In addition, as shown in FIGS. 1-3, the fan frame 110 further includes a power source and signal connecting portion 130, a first connecting plate 112 and a plurality of first elastic structures 113. The side plates 111 respectively include two second protruding portions 114. The second protruding portions 114 are elastically disposed on the fan stopping plates 1111. The first connecting plate 112 is connected with the fan stopping plates 1111. The power source and signal connecting portion 130 is disposed on the first connecting plate 112 and configured to connect with a power source and signal device (not shown). The first connecting plate 112 has a plurality of first hollow portions H1. Each of the fan stopping plates 1111 has a plurality of second hollow portions H2. Each of the first hollow portions H1 of the first connecting plate 112 and the corresponding second hollow portion H2 of the fan stopping plates 1111 communicate with each other. Each of the first elastic structures 113 includes a first connecting portion 1131 and a second connecting portion 1132 connecting with each other. Each of the first connecting portions 1131 is connected with the first connecting plate 112 and is located at one of the first hollow portions H1. The corresponding second connecting portion 1132 is located at the corresponding second hollow portion H2. To be specific, each of the second protruding portions 114 is disposed on the second connecting portion 1132 of the corresponding first elastic structures 113. The fan body 120 has a plurality of second recessed portions R2. The second recessed portions R2 are configured to accommodate the second protruding portions 114 of the fan frame 110. When the fan body 120 is accommodated between the side plates 111 as shown in FIG. 1, the second protruding portions 114 of the fan frame 110 are accommodated in the second recessed portions R2 of the fan body 120, such that the fan body 120 can be fixed inside the fan frame 110.

To be specific, in the process to install the fan body 120 into the fan frame 110, the fan body 120 compresses on the second protruding portions 114 such that the first elastic structures 113 elastically deform. After the positions of the second recessed portions R2 of the fan body 120 match with the second protruding portions 114, the first elastic structures 113 elastically recover such that the second protruding portions 114 are accommodated in the second recessed portions R2. At this point, the positions of the first recessed portions R1 of the fan body 120 also match with the first protruding portions 1112 of the side plates 111, and the first protruding portions 1112 are also accommodated in the first recessed portions R1. In this way, the process to install the fan body 120 to the fan frame 110 is simple and quick without the usage of any extra component or tool. Thus, it is convenient to the user.

In practical applications, each of the second recessed portions R2 of the fan body 120 is a through hole. Moreover, the shape and dimensions of each of the second recessed portions R2 can be the same as the first recessed portions R1.

Furthermore, as shown in FIGS. 1-2, each of the fan stopping plates 1111 has a plurality of third hollow portions H3. Each of the third hollow portions H3 extends along a circular locus to form a fan shape. The third hollow portions H3 are evenly disposed around a center C of the circular locus on the corresponding side plate 111. Correspondingly, as shown in FIG. 3, the fan body 120 has an entrance E1 and an exit E2 (the exit E2 is located at the back of the fan body 120 in FIG. 3) opposite to each other. The entrance E1 and the exit E2 respectively face to the fan stopping plates 1111. In this way, during the operation of the fan body 120, an air flow can enter into the entrance E1 of the fan body 120 through the third hollow portions H3 of the corresponding fan stopping plate 1111, and the air flow blown from the exit E2 of the fan body 120 can leave through the third hollow portions H3 of the other fan stopping plate 1111. Under this condition, the fan stopping plates 1111 can avoid the chance of the fingers from touching the fan blades rotating in high speed (not shown) by mistake.

Furthermore, the fan frame 110 further includes a second connecting plate 115, a second elastic structure 116 and at least one buckling portion 117. The second connecting plate 115 is connected with the fan stopping plates 1111 and the first connecting plate 112. It is worth to note that, the side plates 111, the first connecting plate 112 and the second connecting plate 115 are of an integrally-formed structure. The second connecting plate 115 has a third recessed portion R3 and a fourth recessed portion R4 opposite to each other. The first connecting plate 112 has a fifth recessed portion R5. The fifth recessed portion R5 of the first connecting plate 112 and the fourth recessed portion R4 of the second connecting plate 115 communicate with each other. The second elastic structure 116 is connected with the first connecting plate 112 and at least partially located at the fifth recessed portion R5 of the first connecting plate 112. The buckling portion 117 is disposed on a side of the second elastic structure 116 away from the third recessed portion R3. The buckling portion 117 is configured to buckle with electric equipment 200 (please refer to FIG. 4).

Structurally speaking, the fan stopping plates 1111 of the fan frame 110 are substantially parallel with each other. The first connecting plate 112 and the second connecting plate 115 are substantially perpendicular to the fan stopping plates 1111 respectively. The first connecting plate 112 and the second connecting plate 115 are substantially perpendicular with other. Moreover, the first connecting portion 1131 of each of the first elastic structures 113 and the corresponding second connecting portion 1132 connect to form a "L" shape.

Figure 4:
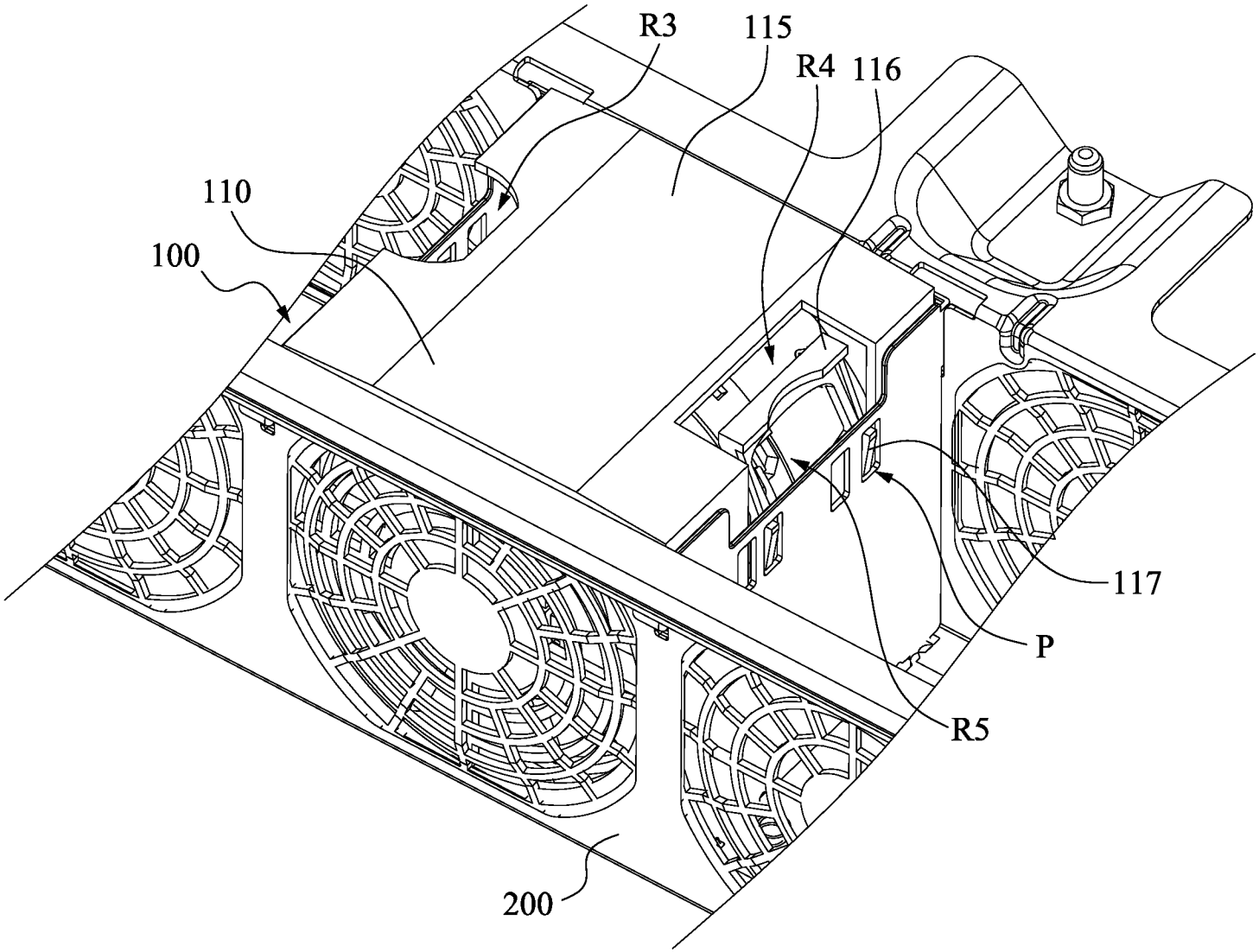
FIG. 4 is a schematic view of the fan structure of FIG. 1 accommodated in electric equipment.

Reference is made to FIG. 4. FIG. 4 is a schematic view of the fan structure 100 of FIG. 1 accommodated in electric equipment 200. In this embodiment, as shown in FIG. 4, a plurality of fan structures 100 can be disposed in the electric equipment 200 to carry out heat dissipation of the electric equipment. 200. For the sake of simplification of the figure, only one fan structure 100 is shown in FIG. 4. To be specific, when the user wants to install the fan structure 100 into the electric equipment 200 or to take the fan structure 100 away from the electric equipment 200, the user can put, for example, the index finger at the position of the first recessed portion R3, and then press on the second connecting plate 115 as a point of force exertion. The user can also press on the second elastic structure 116 of the fan frame 110 by the thumb, such that the second elastic structure 116 deforms elastically towards the third recessed portion R3 of the second connecting plate 115. Under this condition, the user can take the fan structure 100 away from the electric equipment 200, or release the fingers to allow the second elastic structure 116 to elastically recover, such that the buckling portion 117 buckles with the through hole P of the electric equipment 200, in order to complete the installation of the fan structure 100 to the electric equipment 200. Since the process to install the fan structure 100 to the electric equipment 200 or to take the fan structure 100 away from the electric equipment 200 is simple and quick without the usage of any extra component or tool, it is convenient to the user. In practical applications, the buckling portion 117 is a hook structure. However, this does not intend to limit the present disclosure.

In conclusion, when compared with the prior art, the aforementioned embodiments of the present disclosure have at least the following advantages:

(1) In the process to install the fan body into the fan frame, the fan body compresses on the second protruding portions such that the first elastic structures elastically deform. After the positions of the second recessed portions of the fan body match with the second protruding portions, the first elastic structures elastically recover such that the second protruding portions are accommodated in the second recessed portions. At this point, the positions of the first recessed portions of the fan body also match with the first protruding portions of the side plates, and the first protruding portions are also accommodated in the first recessed portions. In this way, the process to install the fan body to the fan frame is simple and quick without the usage of any extra component or tool. Thus, it is convenient to the user.

(2) When the user wants to install the fan structure into the electric equipment or to take the fan structure away from the electric equipment, the user can put, for example, the index finger at the position of the first recessed portion, and then press on the second connecting plate as a point of force exertion. The user can also press on the second elastic structure of the fan frame by the thumb, such that the second elastic structure deforms elastically towards the third recessed portion of the second connecting plate. Under this condition, the user can take the fan structure away from the electric equipment, or release the fingers to allow the second elastic structure to elastically recover, such that the buckling portion buckles with the through hole of the electric equipment, in order to complete the installation of the fan structure to the electric equipment. Since the process to install the fan structure to the electric equipment or to take the fan structure away from the electric equipment is simple and quick without the usage of any extra component or tool, it is convenient to the user.

Although the present disclosure has been described in considerable detail with reference to certain embodiments thereof, other embodiments are possible. Therefore, the spirit and scope of the appended claims should not be limited to the description of the embodiments contained herein.

It will be apparent to the person having ordinary skill in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A fan structure, comprising: a fan frame, comprising: two side plates opposite to each other, each of the side plates comprising: a fan stopping plate; a first protruding portion disposed on the fan stopping plate; and two second protruding portions elastically disposed on the fan stopping plate; a first connecting plate connected with the fan stopping plates, the first connecting plate having a plurality of first hollow portions, each of the fan stopping plates having a plurality of second hollow portions, each of the plurality of first hollow portions and a corresponding one of the plurality of second hollow portions communicating with each other; at least one buckling portion disposed on the first connecting plate and configured to buckle with electric equipment; a power source and signal connecting portion disposed on the first connecting plate and configured to connect with a power source and signal device; and a second connecting plate connected with the fan stopping plates and the first connecting plate; and a plurality of first elastic structures, each of the first elastic structures comprising a first connecting portion and a corresponding second connecting portion connecting with each other, each of the first connecting portions connecting with the first connecting plate and being located at a respective one of the first hollow portions, each corresponding second connecting portion being located at a respective one of the corresponding second hollow portions, each of the second protruding portions being disposed on a respective one of the corresponding second connecting portions; and a fan body suitable to be accommodated between the side plates, the fan body having a plurality of first recessed portions and a plurality of second recessed portions, the first recessed portions being configured to accommodate the first protruding portions, the second recessed portions being configured to accommodate the second protruding portions, wherein the side plates, the first connecting plate and the second connecting plate are of an integrally-formed structure.

2. The fan structure of claim 1, wherein the first connecting portion and the second connecting portion connect to form a "L" shape.

3. The fan structure of claim 1, wherein each of the fan stopping plates has a plurality of third hollow portions, each of the third hollow portions extends along a circular locus to form a fan shape, the third hollow portions are evenly disposed around a center of the circular locus.

4. The fan structure of claim 3, wherein the fan body has an entrance and an exit opposite to each other, the entrance and the exit respectively face to the fan stopping plates.

5. The fan structure of claim 1, wherein the second connecting plate has a third recessed portion and a fourth recessed portion opposite to each other, the first connecting plate has a fifth recessed portion, the fifth recessed portion and the fourth recessed portion communicate with each other, and wherein the fan frame further comprises: a second elastic structure connected with the first connecting plate and at least partially located at the fifth recessed portion, and the buckling portion is disposed on a side of the second elastic structure away from the third recessed portion.

6. The fan structure of claim 5, wherein the buckling portion is a hook structure.

7. The fan structure of claim 5, wherein the fan stopping plates are substantially parallel with each other, the first connecting plate and the second connecting plate are substantially perpendicular to the fan stopping plates respectively.

8. The fan structure of claim 5, wherein the first connecting plate and the second connecting plate are substantially perpendicular with other.

* * * * *